US011149733B2

(12) United States Patent
Schmitz et al.

(10) Patent No.: US 11,149,733 B2
(45) Date of Patent: Oct. 19, 2021

(54) LIQUID-INJECTED COMPRESSOR OR EXPANDER ELEMENT AND METHOD FOR CONTROLLING THE LIQUID INJECTION OF A COMPRESSOR OR EXPANDER DEVICE

(71) Applicant: Atlas Copco Airpower, Naamloze Vennootschap, Wilrijk (BE)

(72) Inventors: Christian Schmitz, Wilrijk (BE); Johan Julia J. Dom, Wilrijk (BE); Peter Karel Anna-Maria Zwysen, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 328 days.

(21) Appl. No.: 16/314,495

(22) PCT Filed: Aug. 23, 2016

(86) PCT No.: PCT/BE2016/000043
§ 371 (c)(1),
(2) Date: Dec. 31, 2018

(87) PCT Pub. No.: WO2018/023177
PCT Pub. Date: Feb. 8, 2018

(65) Prior Publication Data

US 2019/0316585 A1 Oct. 17, 2019

(30) Foreign Application Priority Data

Aug. 1, 2016 (BE) ..... 2016/5623

(51) Int. Cl.
*F04C 18/16* (2006.01)
*F04C 29/02* (2006.01)
(Continued)

(52) U.S. Cl.
CPC ..... *F04C 18/16* (2013.01); *F04C 28/06* (2013.01); *F04C 29/0007* (2013.01);
(Continued)

(58) Field of Classification Search
CPC ..... F04C 18/16; F04C 28/06; F04C 29/0007; F04C 29/02; F04C 29/021; F04C 29/0014; F05B 2260/98; F01C 21/002
See application file for complete search history.

(56) References Cited

U.S. PATENT DOCUMENTS 4,070,166 A * 1/1978 Emanuelsson ..... F04C 29/0007 95/268
4,984,974 A * 1/1991 Naya ..... F04C 29/0092 418/87
(Continued)

FOREIGN PATENT DOCUMENTS

CN 103459852 A 12/2013
CN 104792027 A 7/2015
(Continued)

OTHER PUBLICATIONS

International Search Report and Written Opinion in related PCT Application No. PCT/BE2016/000043, dated Mar. 28, 2017.
(Continued)

*Primary Examiner* — Charles G Freay
(74) *Attorney, Agent, or Firm* — Bacon & Thomas, PLLC

(57) ABSTRACT

Liquid-injected compressor element or expander element with a housing that comprises a rotor chamber in which at least on rotor is rotatably affixed, whereby the element is further provided with a connection for an injection circuit for the injection of liquid into the element, whereby the connection to the injection circuit is realised by means of an injection point in the housing that opens into the first compression chamber or expansion chamber. The connec-
(Continued)

tion to the injection circuit is additionally realised by means of an additional injection point in the housing that opens into a second or subsequent compression chamber or expansion chamber.

7 Claims, 2 Drawing Sheets

(51) Int. Cl.
*F04C 28/06* (2006.01)
*F04C 29/00* (2006.01)
*F01C 21/00* (2006.01)

(52) U.S. Cl.
CPC ..... *F04C 29/02* (2013.01); *F04C 29/021* (2013.01); *F01C 21/002* (2013.01); *F04C 29/0014* (2013.01)

(56) References Cited

U.S. PATENT DOCUMENTS 5,318,151 A 6/1994 Hood et al.
5,626,470 A 5/1997 Gerhardt
6,109,902 A 8/2000 Goris et al.
7,993,110 B1 * 8/2011 Hill ..... F04C 13/008 417/251
8,870,555 B2 * 10/2014 Feller ..... F04C 29/042 418/84
2008/0279708 A1 † 11/2008 Heimonen
2012/0171069 A1 * 7/2012 Huang ..... F04C 29/0035 418/201.2
2012/0207634 A1 * 8/2012 Heger ..... F04C 18/16 418/1
2013/0058822 A1 † 3/2013 Feller

FOREIGN PATENT DOCUMENTS

DE 4042177 † 7/1992
DE 102010002649 A1 7/2012
EP 0 389 036 * 9/1990
EP 2196676 A2 3/2015
JP 406108983 * 4/1994
JP 2001153073 A 6/2001
JP 2003184768 * 7/2003
RU 2073120 C1 2/1997
WO 9005852 † 5/1990
WO 2009121151 A1 10/2009
WO 2011110475 A2 9/2011
WO 2012109302 A2 8/2012

OTHER PUBLICATIONS

Written Opinion of International Preliminary Examining Authority in related PCT Application No. PCT/BE2016/000043, dated Jul. 6, 2018.

* cited by examiner
† cited by third party

LIQUID-INJECTED COMPRESSOR OR EXPANDER ELEMENT AND METHOD FOR CONTROLLING THE LIQUID INJECTION OF A COMPRESSOR OR EXPANDER DEVICE

The present invention relates to a liquid-injected compressor element or expander element.

BACKGROUND OF THE INVENTION

It is known that in compressor elements or expander elements a lubricating liquid, such as oil or water for example, is injected into the housing to provide lubrication between the rotors and also for sealing to minimise leakage losses.

The lubricating liquid will also provide cooling in the case of a compressor element in order to be able to remove the heat that is released during compression.

One example of a known system can be found in U.S. Pat. No. 2012/207,634 A, whereby a compressor system including a lubricant reservoir is disclosed. The injection of liquid into the compression chamber being performed through a first lubricating feed port into a first pressure region and through a second lubricating feed port in the direction of increasing pressure.

In the known compressor elements the lubricating liquid is injected at a location where it cannot come into contact with the inlet of the machine, because the lubricating liquid is usually warmer than the gas to be compressed that is drawn in and any heat exchange between the lubricating liquid and the gas would negatively affect, i.e. reduce, the degree of admission.

Traditionally the injection point is chosen just after the rotating gas chamber is closed off from the inlet, i.e. just at the start of the compression or expansion.

In the case of a compressor element, this has the advantage that a maximum pressure drop is created across the liquid circuit, so that for a given liquid circuit the lubricating liquid flow is a maximum, or so that for a given lubricating liquid flow the liquid circuit can be minimised.

The moment that the rotating gas chamber is closed off from the inlet, it becomes the 'first' compression or expansion chamber. It is at this moment that the compression or expansion will start.

This chamber remains the first compression or expansion chamber until the moment that the rotor has rotated one cycle further, i.e. the rotor has turned one pitch, then it becomes the second compression or expansion chamber.

The injection point is traditionally located on the helical line formed by the tips of the rotor lobes that separate the aforementioned first and second compression chamber or expansion chamber from one another, and this point only comes into contact with the first compression chamber or expansion chamber.

A disadvantage of such known compressor elements or expander elements is that in the subsequent compression or expansion chambers there is no or insufficient sealing or lubrication because insufficient lubricating liquid is present, which is primarily an issue at the start-up of the element and at higher pressures.

Another disadvantage of such known compressor elements is that the lubricating liquid can only cool to a limited extent because the compression has not yet started at the location of the injection so that the gas has barely heated up.

The purpose of the present invention is to provide a solution to at least one of the aforementioned and other disadvantages.

SUMMARY OF THE INVENTION

The object of the present invention is a liquid-injected compressor element or expander element with a housing that comprises a rotor chamber in which two rotors are rotatably affixed, said rotors rotating with their lobes mated together, whereby the element is further provided with a connection for an injection circuit for the injection of lubricating liquid into the element, whereby the connection to the injection circuit is realised by means of an injection point in the housing that opens into the first compression chamber or expansion chamber, whereby the connection to the injection circuit is additionally realised by means of an additional injection point in the housing that opens into a second or subsequent compression chamber or expansion chamber, whereby the first compression chamber or expansion chamber is the gas chamber that is closed off just after a gas inlet of the rotor chamber and said second or subsequent compression chamber or expansion chamber being formed after the at least one rotor have rotated one pitch or revolution from the gas inlet.

An advantage is that liquid is injected in the subsequent compression chamber or expansion chamber so that the necessary sealing and lubrication can also be provided there. That is needed in particular at low speeds or at start-up.

In other words liquid will be injected at the locations where it is needed and useful.

Another advantage is that in the case of a compressor element, at higher pressures a better local seal will be obtained, so that gas being able to leak from the one compression chamber to the other compression chamber can be prevented.

Another advantage is that as the liquid is injected into the element in a more targeted way, i.e. at locations where it is (also) needed, less liquid will have to be injected to obtain the same seal, lubrication and cooling than in the conventional case with injection only in the first compression chamber or expansion chamber.

An additional advantage is that in the case of a compressor element, the efficiency of the cooling by the liquid will be higher as the temperature difference between the liquid and the gas in the second or subsequent compression chamber will be greater so that there will be more heat transfer.

The invention also concerns a method for controlling the liquid injection of a compressor device or expander device, whereby the compressor device or expander device comprises at least one compressor element or expander element, whereby the element comprises a housing that comprises a rotor chamber in which two rotors are rotatably affixed, said rotors (6) rotating with their lobes (7) mated together, whereby lubricating liquid is injected into the element, whereby the method comprises the step of providing at least two liquid supplies to the rotor chamber of the housing, whereby one liquid supply is injected into the first compression chamber or expansion chamber and the other is injected into a second or subsequent compression chamber or expansion chamber, whereby the first compression chamber or expansion chamber is the gas chamber that is closed off just after a gas inlet of the rotor chamber and said second or subsequent compression chamber or expansion chamber being formed after the at least one rotor have rotated one pitch or revolution from the gas inlet.

BRIEF DESCRIPTION OF THE DRAWINGS

With the intention of better showing the characteristics of the invention, a few preferred variants of a liquid-injected compressor element or expander element according to the invention and a method for controlling the liquid injection of a compressor device or expander device are described hereinafter, by a way of an example without any limiting nature, with reference to the accompanying drawings wherein.

DETAILED DESCRIPTION OF THE INVENTION

Figure 1:
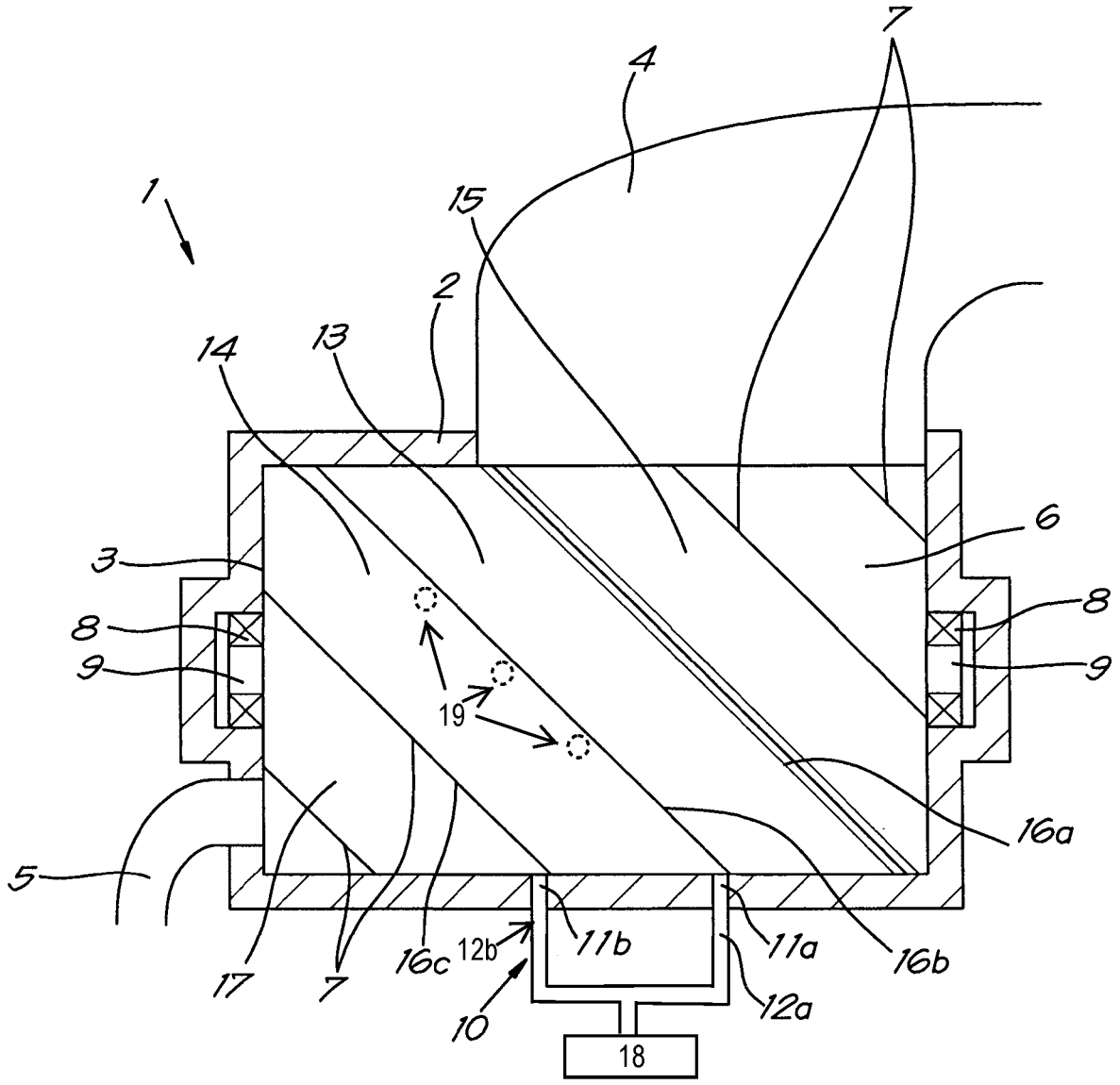
FIG. 1 schematically shows a compressor element according to the invention.

The compressor element 1 according to the invention schematically shown in FIG. 1 comprises a housing 2 that defines a rotor chamber 3.

The rotor chamber 3 is provided with a gas inlet 4 and a gas outlet 5 for compressed gas.

One or more rotors 6 are rotatably affixed in the housing 2. In this case there are two rotors 6 that rotate with their lobes 7 mated together.

The rotors 6 are rotatably affixed in the housing 2 by means of bearings 8, in this case in the form of two bearings that are affixed on the shafts 9 of the rotors 6. The bearings 8 can be realised by means of roller bearings or can be realised in the form of plain bearings.

Furthermore the compressor element 1 is provided with a connection 10 for an injection circuit for the injection of liquid into the compressor element 1.

This liquid can for example be synthetic oil or water or otherwise, but the invention is not limited to this as such.

According to the invention the connection 10 to the injection circuit is realised by means of an injection point 11*a* in the housing 2 that is connected to an injection pipe 12*a* of the injection circuit and which opens into the first compression chamber 13.

The first compression chamber 13 is the gas chamber that is closed off just after the inlet, as shown in FIG. 1. It is at this moment that the compression will start.

This chamber remains the first compression chamber 13 until the moment that the rotors 6 have rotated one cycle or pitch further. At this moment this chamber becomes the second compression chamber 14.

Note that at this time a new first compression chamber 13 is formed, by the chamber that was previously the inlet chamber 15 that was connected to the inlet 4.

The first injection point 11*a* is chosen such that it always opens into the first compression chamber 13 irrespective of the position of the rotors 6 so that this injection point 11*a* can never come into contact with the inlet 4 and the inlet chamber 15.

In this way oil is prevented from being able to get in the inlet chamber 15.

According to the invention, the connection 10 to the injection circuit is additionally realised by means of an additional injection point 11*b* in the housing 2 that is connected to a second injection pipe 12*b* of the injection circuit and which opens into a second compression chamber 14 or subsequent compression chamber.

The second compression chamber 14 is, as already explained above, located one pitch or revolution of the rotors 6 from the inlet.

In this case both the injection point 11*a* and the additional injection point 11*b* are located on a helical line 16*a*, 16*b*, 16*c* that is formed by the tips of the rotor lobes 7 that separate successive compression chambers 13, 14 from one another.

Note that these helical lines 16*a*, 16*b*, 16*c* are traced out, so to speak, by the tips of the rotor lobes 7 on the housing 2, at least on the walls of the rotor chamber 3.

These helical lines 16*a*, 16*b* are shown in FIG. 1. The inlet helical line 16*a* separates the inlet chamber 15 that is connected to the inlet 4 of the first compression chamber 13. The next helical line 16*b* separates the first compression chamber 13 from the second compression chamber 14.

The injection point 11*a* lies on this helical line 16*b*. As a result it can be ensured that the oil that is injected via this injection point 11*a* can never get into the inlet 4.

The additional injection point 11*b* is on a subsequent helical line 16*c* that separates the second compression chamber 14 from the third compression chamber 17.

As already stated, two rotors 6 are rotatably affixed in the rotor chamber 9, whereby in this case an additional injection point 11*b* is provided for each rotor 6, i.e. at the location of or at the side of each rotor 6.

In this way each of these injection points 11*b* will lie on a helical line 16*c* that is traced out on the walls of the rotor chamber 3 by the tips of the lobes 7 of the rotor 6 concerned.

Such a compressor element 1 can be used in a compressor device, not shown in the drawings, that is provided with an injection circuit 18 that is connected to the injection points 11*a*, 11*b*, whereby this injection circuit can be controlled such that the quantity and temperature of the liquid that is injected can be controlled.

The operation of the compressor element 1 is very simple and as follows.

During the operation of the compressor element 1 a gas, for example air, will be drawn into the rotor chamber 3 via the gas inlet 4, more specifically into the inlet chamber 15, whereby due to the operation of the rotors 6 the gas will be compressed and leave the compressor element 1 via the outlet 5.

During operation, liquid will be injected into the rotor chamber 3 to provide lubrication, sealing and cooling.

The liquid is injected into the first compression chamber 13 via the injection point 11*a* and into the second compression chamber 14 via the additional injection point 11*b*.

The quantity of liquid that is supplied via the injection pipes 12*a*, 12*b* can be adjusted according to the prevailing requirements at that time.

For example the injection flows can be driven on/off, whereby either no liquid is injected or a predetermined quantity is injected.

It is also possible that the temperature of the liquid that is injected via the injection point 11*a* and the additional injection point 11*b* is controlled, whereby the control can be done separately for both injection points 11*a*, 11*b*.

The Belgian patent application No. 2016/5147 of the same applicant goes into this more deeply.

It is possible that the injection point 11*a* or additional injection point 11*b* is made up of a number of sub-injection points.

Each of the sub-injection points 19 that form the injection point 11*a* open into the first compressor chamber 13 and are preferably located on the aforementioned helical line 16*b* that separates the first compression chamber 13 from the second compression chamber 14.

Analogously the sub-injection points that form the additional injection point 11*b* open into the second compression chamber 14 and are preferably located on the helical line 16*c* between the second compression chamber 14 and the third compression chamber 17.

It is also possible that there is more than one additional injection point 11*b* whereby these additional injection points lib each open into a different compression chamber 14, 17, i.e. in addition to the additional injection point 11*b* that opens into the second compression chamber 14, there are also one or more additional injection points 11*b* that open into the third compression chamber 17 or a subsequent compression chamber.

In this way liquid will be injected into the first, second and third compression chamber 13, 14, 17.

It is also possible that there is only one additional injection point 11*b* that opens into the third compression chamber 17 or subsequent compression chamber and in other words that liquid is injected into the first compression chamber 13 into the third compression chamber 17, but not into the second compression chamber 14.

Figure 2:
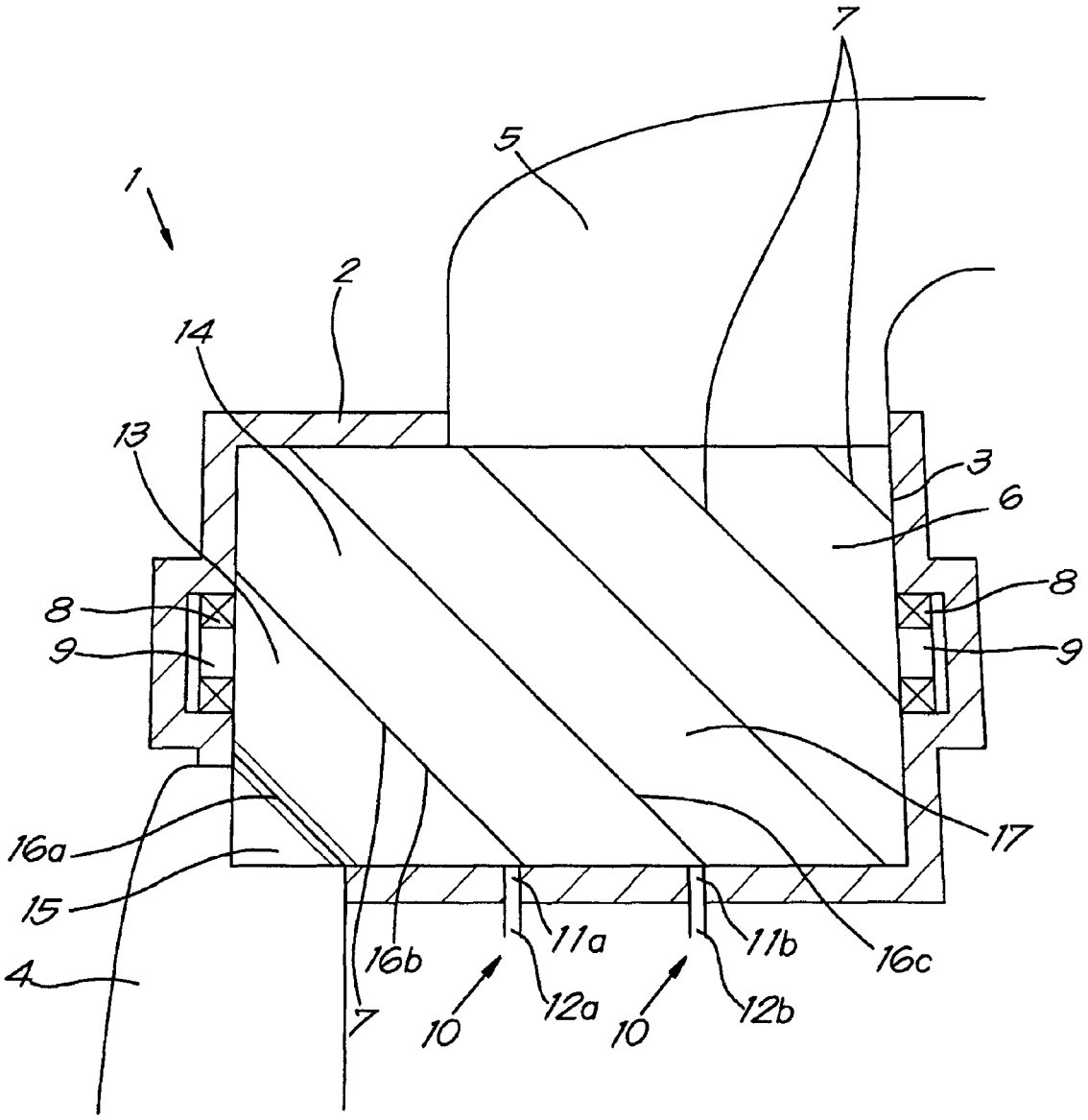
FIG. 2 schematically shows an expander element according to the invention.

FIG. 2 shows an expander element 1 according to the invention.

This embodiment essentially differs from the previous one by the fact that the inlet 4 and the outlet 5 are swapped around as it were. This means that the inlet helix 16*a* and the first expansion chamber 13 are located on the other side of the element 1.

The form of the inlet 4 is also different: the inlet 4 has both an axial and a radial section. The invention is not limited to this as such, and inlets and outlets for compressor elements and expander elements can have radial and axial sections.

The injection point 11*a* is located on the helical line 16*b* that separates the first expansion chamber 13 from the second expansion chamber 14 and the additional injection point 11*b* is located on the subsequent helical line 16*c*.

The injection point 11*a* will inject liquid into the first expansion chamber 13. It is this gas chamber that is just separated from the inlet 4 of the expander element 1.

When the rotors 6 have turned one pitch or revolution further, this first expansion chamber 13 becomes the second expansion chamber 14 in which the additional injection point 11*b* will inject liquid.

The aforementioned additional elements and variants can be applied mutatis mutandis for an expander element.

Although the foregoing is described for a compressor element or expander element 1, the invention is also applicable to a vacuum pump, which in essence is also a compressor element 1 or compressor device.

The present invention is by no means limited to the embodiments described as an example and shown in the drawings, but a liquid-injected compressor element or expander element according to the invention and a method for controlling the liquid injection of a compressor device or expander device can be realised according to different variants without departing from the scope of the invention.

The invention claimed is:

1. A liquid-injected compressor or expander comprising:

a housing that comprises a rotor chamber in which two rotors are rotatably affixed, said rotors rotating with lobes of the rotors being able to mate together, wherein the compressor or expander further comprises a connection connected to an injection circuit for the injection of a lubricating liquid into the compressor or expander, wherein the connection to the injection circuit is realised by means of a first injection point in the housing that always opens into a first compression chamber or expansion chamber, wherein the connection to the injection circuit is additionally realised by means of a second injection point in the housing that opens into a second or subsequent compression chamber or expansion chamber, wherein the first compression chamber or expansion chamber is a gas chamber that is closed off after a gas inlet of the rotor chamber and said second or subsequent compression chamber or expansion chamber being formed after at least one rotor of the two rotors has rotated one pitch or revolution from the gas inlet, wherein the first injection point is located on a first helical line formed by a tip of a lobe of a rotor that separates the first compression chamber or expansion chamber from the second or subsequent compression chamber or expansion chamber and the second injection point is located on a second helical line formed by a second tip of a second or subsequent lobe of the rotor that separates the second or subsequent compression chamber of expansion chamber from a successive compression chamber, wherein the first injection point and the second injection point, further comprises a number of sub-injection points that each open into the first compression chamber or expansion chamber, or the second or subsequent compression chamber or expansion chamber, respectively.

2. The liquid-injected compressor or expander according to claim 1, wherein there is at least one additional injection point, each at least one additional injection point opens into a different subsequent compression chamber or expansion chamber.

3. The liquid-injected compressor or expander according to claim 2, wherein each at least one additional injection point further comprises a number of sub-injection points that each open into the respective different subsequent compression chamber or expansion chamber.

4. The liquid-injected compressor or expander according to claim 1, wherein the two rotors are rotatably affixed in the rotor chamber and the second injection point is provided for each rotor.

5. The liquid-injected compressor or expander according to claim 1, wherein a quantity of lubricating liquid that is injected via the first injection point and the second injection point are able to be controlled.

6. The liquid-injected compressor or expander according to claim 1, wherein a temperature of the lubricating liquid that is injected via the first injection point and the second injection point are able to be controlled.

7. A method for controlling liquid injection of a compressor installation or expander installation, w herein the compressor installation or expander installation comprises at least one compressor or expander, w herein the at least one compressor or expander comprises a housing that comprises a rotor chamber in which two rotors are rotatably affixed, said rotors rotating with lobes of the rotors mated together, wherein lubricating liquid is injected into the compressor or expander, wherein the method comprises the step of:

providing at least two liquid supplies to the rotor chamber of the housing, wherein one liquid supply of the at least two liquid supplies is always injected into a first compression chamber or expansion chamber and the other of the at least two liquid supplies is injected into a second or subsequent compression chamber or expansion chamber, wherein the first compression chamber or expansion chamber is a gas chamber that is closed off after a gas inlet of the rotor chamber and said second or subsequent compression chamber or expansion chamber being formed after at least one rotor of the two rotors has rotated one pitch or revolution from the gas inlet, wherein a first injection point is located on a first helical line formed by a tip of a lobe of a rotor that separates the first compression chamber or expansion chamber from the second or subsequent compression chamber or expansion chamber and a second injection point is located on a second helical line formed by a second tip of a second or subsequent lobe of the rotor that separates the second or subsequent compression chamber of expansion chamber from a successive compression chamber, wherein the first injection point and the second injection point, further comprises a number of sub-injection points that each open into the first, or second or subsequent compression chamber or expansion chamber, respectively.

* * * * *